United States Patent [19]

Mrklas

[11] Patent Number: 4,876,972

[45] Date of Patent: Oct. 31, 1989

[54] GRATE BAR ELEMENT FOR A SLIDING GRATE FURNACE FOR GARBAGE INCINERATION

[76] Inventor: Louis Mrklas, c/o Fam. Löer, Feledstr. 21, D-4352 Herten, Fed. Rep. of Germany

[21] Appl. No.: 184,378

[22] Filed: Apr. 21, 1988

[30] Foreign Application Priority Data

Apr. 25, 1987 [DE] Fed. Rep. of Germany ..... 371608

[51] Int. Cl.[4] ..... F23H 3/00

[52] U.S. Cl. ..... 110/298; 126/163 R

[58] Field of Search ..... 110/298, 299, 300; 126/163 R, 163 A

[56] References Cited

U.S. PATENT DOCUMENTS

| | | | |
|---|---|---|---|
| 2,116,024 | 5/1938 | Helmick | 126/163 R |
| 2,745,364 | 5/1956 | Martin | 110/298 |
| 4,463,688 | 8/1984 | Andreoli | 110/298 |
| 4,719,900 | 1/1988 | Martin | 110/298 X |

*Primary Examiner*—Edward G. Favors

*Attorney, Agent, or Firm*—Bierman and Muserlian

[57] ABSTRACT

In a grate bar element for a sliding grate furnace for garbage incineration, where the individual grate bar elements are formed for imbricate arrangement and have at their ends openings for the escape of combustion air, the layout is such that each grate bar element (1) has, for multiple circulation of the material (3) to be incinerated, at least two skid surfaces (9, 10) arranged one above the other in cascade fashion, which are limited at their end by steplike lugs (**22, 22*a*). The air outlet openings are provided in each lug (22, 22*a*) of the grate bar element (1) and are designed as air outlet slots (5, 6) for the horizontal or parallel supply of combustion air to the contiguous next skid surface (9, 10) which slots extend over largely the total width of the grate bar element (1). Each grate bar element (1) is subdivided vertically by an inner longitudinal center web, at whcih air passages (23, 24) are formed on both sides for the supply of the combustion air to the air outlet slots (5, 6**).

6 Claims, 3 Drawing Sheets

GRATE BAR ELEMENT FOR A SLIDING GRATE FURNACE FOR GARBAGE INCINERATION

Figure 1:
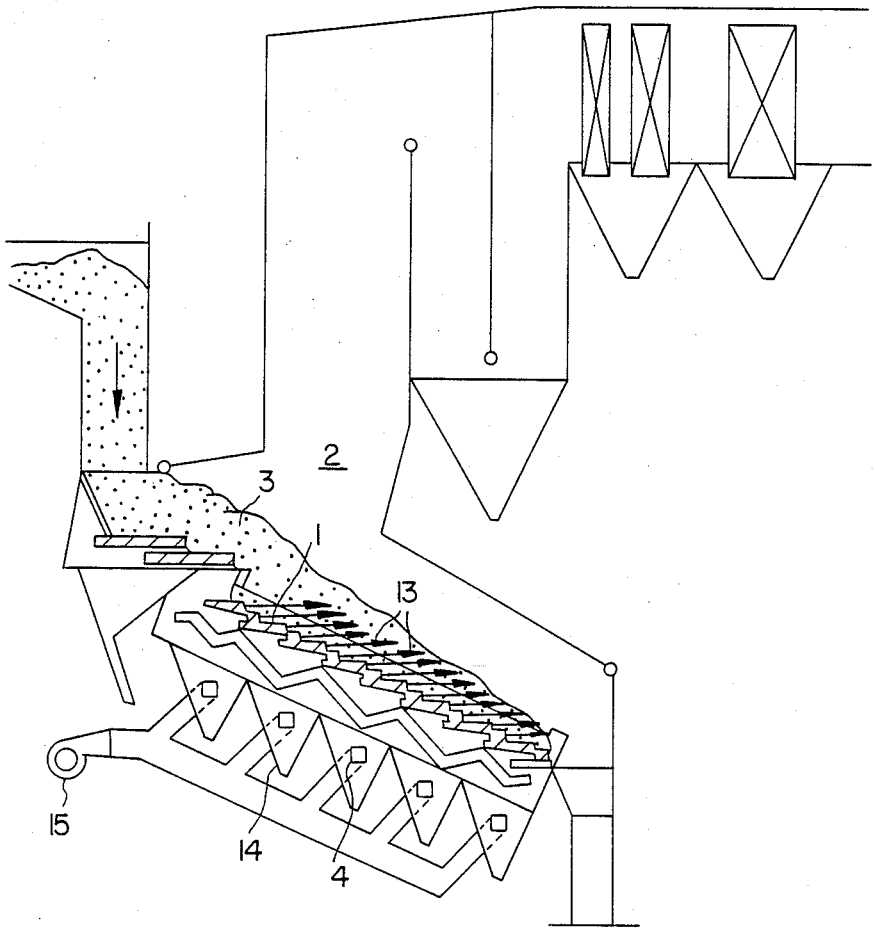

The invention relates to a grate bar element for a sliding grate furnace for garbage incineration according to the preamble of claim 1.

Such sliding grate furnaces, which may have a feed grate, reverse feed grate, horizontal grate, counter-running grate, push-over grate, longitudinal feed grate or the like, serve for the incineration of household trash or trash-like or pasty waste material. Here combustion air is supplied to the material to be incinerated, which air issues from openings at the respective end of the grate bar elements and not only is to bring about uniform combustion of the waste material but also serves for the forced cooling of the bar elements.

In a known grate bar element of the kind in question (DE-OS 33 13 615 or respectively U.S. Pat. No. 4,463,688) the air outlet opening at the end of each grate bar element is formed as a bore of relatively small cross section. The result is that the combustion air issuing from these bores cannot be directed onto the material to be incinerated in sufficiently large quantity. It is therefore still necessary to inject additional combustion air vertically from the bottom upwardly through a longitudinal gap necessarily provided between two adjacent grate bar elements. Such a vertical longitudinal gap between two adjacent grate bar elements, however, largely rules out the combustion of pasty waste materials, because there is danger that such pasty waste materials will penetrate into the vertical longitudinal gap between two grate bar elements in an undesirable manner. And lastly, due to different gap openings, caused by jamming or wedging of the individual grate bar elements, the material to be incinerated is caused to get stuck in the longitudinal gap. This in turn causes an irregular supply of combustion air and hence too high a velocity of the combustion air, resulting in too high a combustion temperature of the material on the grate bar elements. This entails directly serious disadvantages which consist in that too high a wall temperature occurs on the respective top side of the grate bar elements serving as skid surface, thereby bringing about an undesired metallic welding-on on the skid surfaces of the grate bar elements.

Since in the known grate bar elements the combustion air is not supplied specificlaly to the outlet openings, there results a supply of combustion air which is irregular on the whole. This does not ensure optimum combustion, indirectly leading to the known disadvantages, namely excessive formation of carbon monoxide and resulting corrosion of the grate bar elements.

Furthermore, also the longitudinal gaps between the known grate bar elements, which serve to supply additional combustion air in vertical direction, have a disadvantageous effect because unburned household trash or the like falls through these gap openings into the ash hoppers under them. This involves the danger that the garbage falling through may be ignited by the ash particles falling down red hot, thereby causing a fire in the hopper below the sliding grate.

It is, therefore, the object of the invention to develop the grate bar element of the kind in question so as to eliminate the disadvantages described, at little construction cost, in such a way that optimum combustion of the household trash or the like is ensured and at the same time the grate bar element is treated as gently as possible or respectively a long useful life is assured for it.

This problem is solved in the grate bar element according to the invention by the features indicated in claim 1. Advantageous developments thereof are described in the additional claims.

With the grate bar element designed according to the invention, the disadvantages inherent in the known grate furnaces for garbage incinerators are completely avoided because, regardless of whether the household trash to be burned is dry or wet or pasty, uniform and optimum combustion of the material to be incinerated is ensured. The grate bar element according to the invention is designed as an element cooled by forced air to which the combustion air is supplied through openings formed as air outlet slots extending over largely the total width of the grate bar element.

Preferably each grate bar element consists of heat-resistant cast steel of high chromium content, the individual grate bar elements being face-milled on both sides and having lateral bores to receive screws or similar connecting means of heat-resistant steel. Thereby a gap-free grate area can be formed in a simple manner, for which there is no longer any danger that pasty or other waste material penetrates between the individual grate bar elements.

Optimum combustion and optimum burnout of the waste material are achieved in that the combustion air is injected horizontally and uniformly through the air outlet slots provided in each grate bar element in at least two steps over the total combustion grate width and length. Thereby the skid surfaces of the grate bar element are cooled at the same time in advantageous manner due to the impinging combustion air, so that thereby the undesired formation of metallic weld accretions is prevented with certainty.

Due to the fact that according to the invention each grate bar element has at least two skid surfaces arranged one above the other in cascade fashion which are limited at their end by step-like lugs or shoulders, it is ensured in the reciprocating movement of the grate bar elements that each individual grate bar element rolls the household trash or other refuse over several times during its combustion.

Further it is essential in the invention that the air outlet slots extend largely over the total width of the grate bar element. The only structural limitation here is that each grate bar element is subdivided vertically by an inner longitudinal center web, which serves for heat removal. This heat removal is further supported by cooling ribs extending largely horizontally, which are provided on either side of the vertical longitudinal center web and limit the individual air passages.

In further development of the invention, these air passages are designed so that the combustion air issues from the air outlet slots as a largely laminar nozzle jet and impinges on the trash or the like present on the skid surface disposed before them and then penetrates into the trash. It is of special importance here that the form and cross-sectional pattern of the air passages are chosen so that at the level of the air outlet slots the total or substantially the total pressure energy of the supplied combustion air, produced by the primary air fan, is transformed into velocity, and this without appreciable pressure loss.

In further development of the invention, the above-mentioned advantages are reinforced by the fact that the air outlet slots are formed as conically tapering nozzles, in which the inclination of the inside wall of the nozzles is at most 10° to 11° to the center axis. Thereby least possible pressure loss combined with largely laminar flow pattern of the combustion air issuing from the nozzles is ensured.

Figure 2:
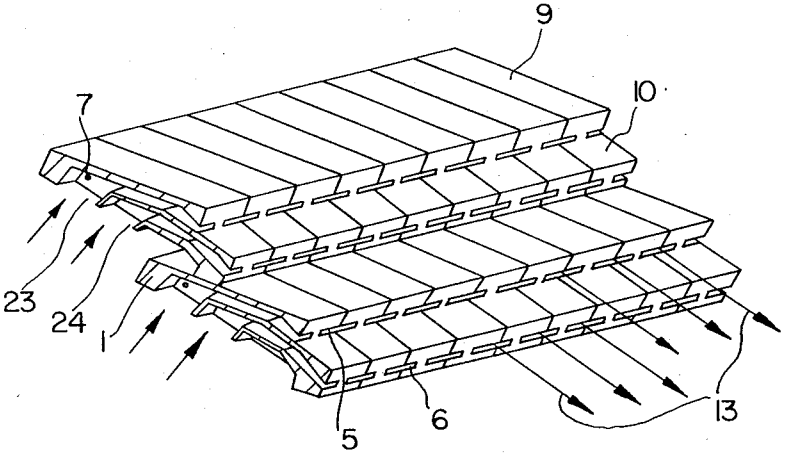
Figure 3:
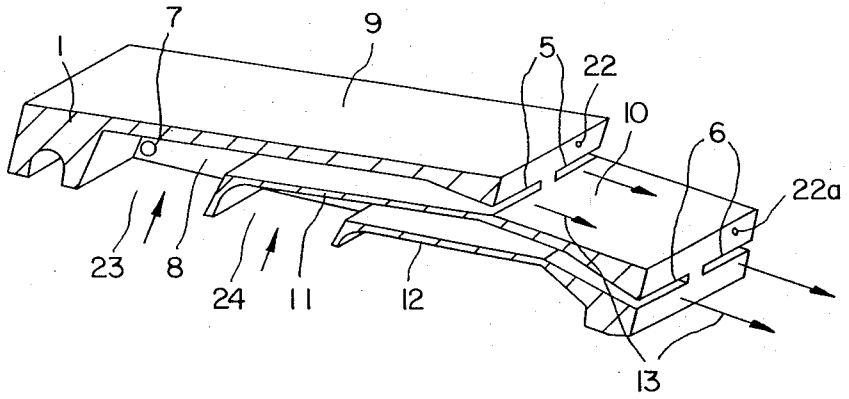

In the following, the invention will be explained more specifically with reference to the drawing in the form of an embodiment example. The drawing shows:

FIG. 1, schematically in transverse section, a sliding grate furnace for garbage incineration formed by individual grate bar elements according to the invention;

FIG. 2, perspectively and partly in section, two grate bar elements disposed one above the other like roof tiles; and FIG. 3, enlarged, perspectively and partly in section, a single grate bar element.

As can be seen from FIG. 1, a feed combustion grate formed by individual grate bar elements 1 is provided, which is arranged below a hearth 2 and charged with material 3 in the form of household trash or the like supplied from above.

Below the grate bar elements 1 air distributor boxes 4 are arranged, which are lodged in ash hoppers 14 and through which combustion air is supplied to the forced-air cooled grate bar elements 1 by means of a fan 15. In a manner still to be described, this combustion air, which serves at the same time as cooling air for the grate bar elements 1, issues largely horizontally in the blowing direction marked by the arrows 13 and passes as a largely laminar nozzle jet into the material 3 to be incinerated lying on the grate bar elements 1.

As can be seen specifically from FIGS. 2 and 3, in the form of realization illustrated, each grate bar element 1 has two skid surfaces 9, 10, which are arranged one above the other in cascade fashion and serve for multiple circulation of the material 3 to be incinerated. At their respective end, the skid surfaces 9, 10 are limited by a step-like lug 22 or 22*a* or by a shoulder.

Each grate bar element 1 is subdivided vertically, for heat removal, by an inner longitudinal center web 8, at which are formed on both sides two air passages 23, 24 for supplying combustion air to the skid surfaces 9, 10. This combustion air issues from air outlet slots 5, 6 provided in the lugs 22, 22*a* limiting the ends of the skid surfaces 9, 10. These air outlet slots 5, 6 extend over largely the total width of the grate bar element 1 and, as can be clearly seen from FIG. 3, are formed as conically tapering nozzles in such a way that the inclination of the inner wall of the nozzles is at most 10° to 11° to the center axis of the nozzle and that thus the combustion air issues from the air outlet slots 5, 6 in the form of a largely laminar nozzle jet 13. The form and cross-sectional pattern of the air passages 23, 24 are chosen so that at the level of the air outlet slots 5, 6 the total pressure energy of the combustion air is largely transformed into velocity. Hence the laminar air jet 13 impinges on the household trash 3 present on the respective skid surfaces 9, 10 at high speed, and this ensures effective penetration of the combustion air into the house trash 3 and hence optimum combustion.

The two air passages 23, 24 provided on both sides of the vertical longitudinal center web 8 are are limited or marked off from each other by cooling ribs (11,12) extending largely horizontally and are connected with the longitudinal center web (8). The combustion air issuing from air outlet slots 5,6 support the heat removal from the skid surfaces 9, 10. At the same time, the combustion air flowing in through the air passages 23, 24 is thereby heated in a desirable manner. By the thus effectively cooled skid surfaces 9, 10 the temperature on the top side of the grate bar elements 1 is kept very low, so that thereby the undesired metallic welding-on of material is prevented.

The combustion air uniformly injected over the total combustion grate width brings about a steady and optimum incineration of the house trash 3 or the like, so that thereby the carbon monoxide content is largely reduced.

Each grate bar element 1 has in its longitudinal center web 8 bores 7 for receiving screws or similar connecting means not shown in detail. Thereby the grate bar elements 1, which are face-milled on both sides, can be joined together to a gap-free, tight combustion grate area, so that even pasty material 3 can be charged on such a tight combustion grate for the purpose of incineration, without danger of this material 3 penetrating between the grate bar elements 1.

I claim:

1. Grate bar element for a sliding grate furnace for garbage incineration, where the bar elements are adapted to be arranged lying one on the other like roof tiles and have at their ends openings for the escape of combustion air, characterized in that for multiple circulation of the material (3) to be incinerated each grate bar element (1) has at least two skid surfaces (9, 10) which are limited at their ends by step-like lugs (22, 22a) or shoulders, the air outlet openings are provided in each lug (22, 22a) of the grate bar element (1) and are formed, for horizontal or parallel supply of combustion air onto the adjacent next skid surface (9 or 10), as air outlet slots (5, 6) which extend over largely the total width of the grate bar element (1), and for heat removal each grate bar element (1) is subdivided vertically by an inner longitudinal center web, at which air passages (23, 24) for the supply of combustion air to the air outlet slots (5, 6) are formed on both sides.

2. Grate element according to claim 1, characterized in that on both sides of the vertical longitudinal center web (8) the air passages (23, 24) are limited or are marked off from each other by cooling ribs (11, 12) extending largely horizontally which are connected with the longitudinal center web (8).

3. Grate bar element according to claim 1 or 2, characterized in that the form and cross-sectional pattern of the air passages (23, 24) are such that the combustion air issues from the air outlet slots (5, 6) as a largely laminar nozzle jet (13) and/or at the level of the air outlet slots (5, 6) largely the entire pressure energy of the combustion air is transformed into velocity without appreciable pressure loss.

4. Grate bar element according to claim 1, characterized in that the air outlet slots (5, 6) are formed as nozzles whose cross section tapers from the beginning to the end of the nozzle.

5. Grate bar element according to claim 4, characterized in that the inclination of the inside wall of the nozzle is at most 10° to 11° to the center axis.

6. Grate bar element according to claim 1, characterized in that each grate bar element (1) is face milled on both sides and has bores (7) for receiving connecting means for the formation of a gap-free combustion grate surface.

* * * * *